US005375391A

United States Patent [19]

Persson et al.

[11] Patent Number: 5,375,391

[45] Date of Patent: Dec. 27, 1994

[54] DEVICE FOR GUIDANCE OF OBJECTS CONNECTED IN STRIP FORM

[75] Inventors: Göran Persson; Micael Akesson, both of Lund, Sweden

[73] Assignee: Tetra Laval Holdings & Finance SA, Pully, Switzerland

[21] Appl. No.: 830,358

[22] Filed: Jan. 31, 1992

[30] Foreign Application Priority Data

Feb. 1, 1991 [SE] Sweden ..... 9100317

[51] Int. Cl.[5] ..... B65B 61/18

[52] U.S. Cl. ..... 53/133.1; 226/199

[58] Field of Search ..... 226/199; 53/128.1, 133.1, 53/133.2, 133.3, 135.1, 136.1, 389.4

[56] References Cited

U.S. PATENT DOCUMENTS

| | | | |
|---|---|---|---|
| 2,273,565 | 2/1942 | Euth et al. | 226/199 X |
| 3,313,090 | 4/1967 | Kerrigan | 53/136.1 X |
| 4,293,369 | 10/1981 | Dilot et al. . | |
| 4,362,075 | 12/1982 | Utsumi . | |
| 4,584,819 | 4/1986 | Hakansson . | |
| 4,669,699 | 6/1987 | Kaneko | 53/133.1 X |
| 4,750,660 | 6/1988 | Kamimura | 226/199 |
| 4,903,458 | 2/1990 | Hakansson . | |
| 4,969,308 | 11/1990 | Hakansson | 53/133.1 X |

FOREIGN PATENT DOCUMENTS

| | | |
|---|---|---|
| 0368011 | 10/1989 | European Pat. Off. . |
| 7801067-5 | 7/1979 | Sweden . |
| 2031839 | 4/1980 | United Kingdom . |

*Primary Examiner*—Linda B. Johnson

*Attorney, Agent, or Firm*—Burns, Doane, Swecker & Mathis

[57] ABSTRACT

A device for guiding objects that are connected to one another in a strip form and that are to be individually applied to packaging containers includes a feed wheel for receiving the objects and feeding them in a forward direction. A guide plate surrounds an end of the feed wheel and the guide plate is connected to an arrangement that allows the position of the guide plate to be adjusted relative to the feed wheel.

16 Claims, 3 Drawing Sheets

DEVICE FOR GUIDANCE OF OBJECTS CONNECTED IN STRIP FORM

FIELD OF THE INVENTION

The present invention pertains to a device for guiding objects that are to be attached to containers. More particularly, the present invention concerns a device for guiding objects connected in strip form when applying the objects to packaging containers, wherein this device includes a drive mechanism for feeding the objects.

BACKGROUND OF THE INVENTION

Within the packaging industry, e.g. in the manufacture of parallelepiped-shaped packages with liquid foodstuffs, objects e.g. straws or spoons will often be applied to the packaging container. These various objects for application are often found in connected strip form where each single object is individually prepacked between two thin plastic films. The object is separated from the connected strip and applied to each packaging container.

Within the packaging industry various types of straws have been developed such as straight tubes of various lengths or various diameters, U-shaped tubes or telescopic tubes. These different types of tubes often require individual height positioning on the packaging container for each type of tube and for each size of packaging container, so that the tube does not project beyond the periphery of the packaging container. This con entail a disadvantage when the packaging container is often collectively distributed in some form of collective container.

Hitherto in order to satisfy the requirement for different straws on packaging containers, a number of different feed wheels has been used, i.e. drive mechanisms for onward feed of the connected straw strip. The feed wheel has been adjusted in height with a spring-loaded plate placed under the feed wheel. This has entailed an ever greater requirement for different spare parts and also difficulties when it is wished to change the feed wheel quickly in order to change the length of straw when production is in progress.

OBJECTS AND SUMMARY OF THE PRESENT INVENTION

An aim of the present invention is to make possible the use of a small number of different feed wheels for all types of straws currently known today.

A further aim of the present invention is to provide a machine in which the adjustment of the application height can be carried out with a single screw adjustment, without the necessity of changing parts in the application machine.

These and other applications have been achieved according to the invention through the fact that the device is designed such that one end of the drive mechanism is completely or partly enclosed by a guide plate which is adjustable in the longitudinal direction of the drive mechanism.

BRIEF DESCRIPTION OF THE DRAWING

Preferred embodiments of the invention will now be described in greater detail with reference to the drawings in which.

DETAILED DESCRIPTION OF THE PREFERRED EMBODIMENT

Figure 1:
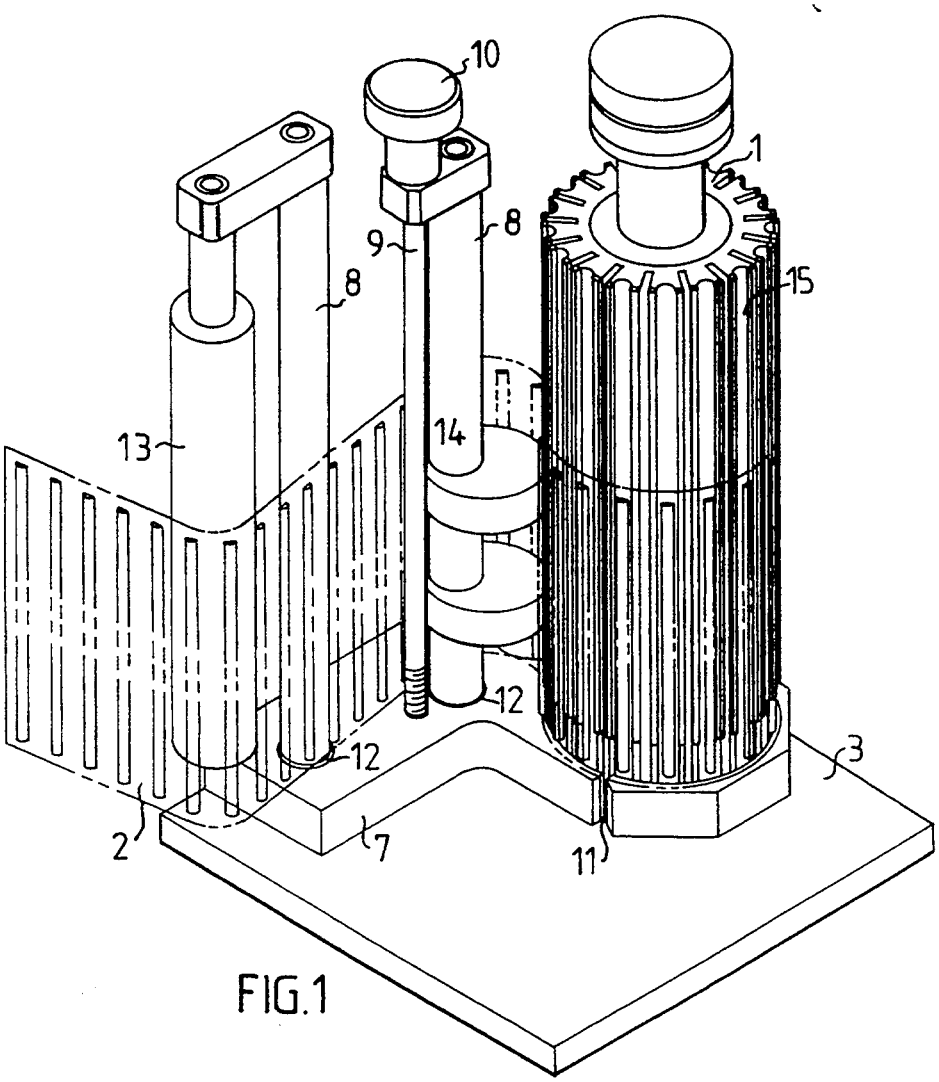
Fig. 1 is a perspective view of the device including an illustration of the path of the connected strip of straws into the drive mechanism.

The drawings only show those details essential for understanding the invention, and other parts of the application machine which are well known to the specialist are left out. A complete description of an application machine can be seen e.g. from Swedish publication SE 424847 (Swedish Patent N. 7801067-5.)

The drive mechanism, or feed wheel 1, which brings forward the connected strip of straws 2 to the position of application is set up on an application machine in the middle of a conveyor belt where the packaging containers which are to be provided with straws or similar objects are brought forward. The feed wheel 1 is fastened on a plate 3 which can be fixed or turned at different angles, so that the application can be done at different angles on the packaging container. Under the plate 3 the feed wheel 1 is connected via a drive axle 4 to a stepped motor 5 for forward feeding of the feed wheel 1 for each application of straws or similar objects to the packaging container. The feed wheel 1 also has in its immediate vicinity a mechanism for separating the various straws from the connected strip. This mechanism most frequently consists of a knife which is controlled by some form of pneumatically controlled piston and cylinder unit. Further the feed wheel 1 is surrounded by various forms of press-on devices for pressing the straw, after it has been separated from the connected strip 2, fixedly on to the packaging container.

Figure 2:
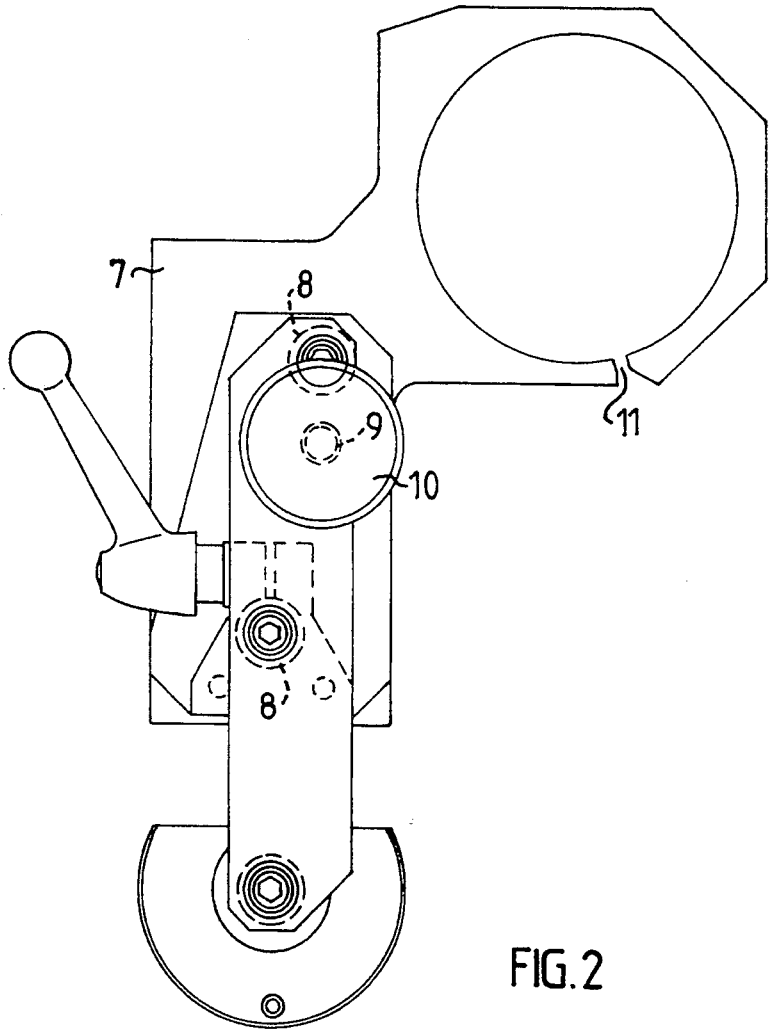
FIG. 2 is a plain view the guide device shown FIG. 1

As shown in FIG. 1, the plate 3 on which the feed wheel 1 is mounted is fitted at the top with a guide plate 7. This plate 7 can be fabricated of various materials such as plastic, hard rubber, metal or the like. In the preferred embodiment the plate 7 is made of plastic. The form of the plate 7, which can be seen from FIG. 2, can be varied and its appearance is in principle unimportant. It should surround the feed wheel 1 as much as possible without encroaching on the space for the keeper 16, separator or press-on device 6. The guide plate must also be delimited so that it does not interfere with the movement of the conveyor. It should also contain room for the guide axles 8 to permit adjustment of the height of the plate 7. In the preferred embodiment, the adjustment plate 7 has two guide axles 8 and an adjustment spindle 9 situated between the guide axles 8. One end of the adjustment spindle, where it engages the adjustment plate 7, is threaded and its other end exhibits an adjustment knob 10 for setting the height of the adjustment plate 7. The adjustment knob or similar feature can, of course, be placed under the plate 3, but due to the lack of space, in the preferred embodiment it is placed above the plate 3. The adjustment plate 7 surrounds almost the whole feed wheel 1, but in the preferred embodiment it is provided with a cut-out 11 where the separating device which separates the individual objects from the connected strip 2 can move in towards the feed wheel to separate the objects.

Figure 3:
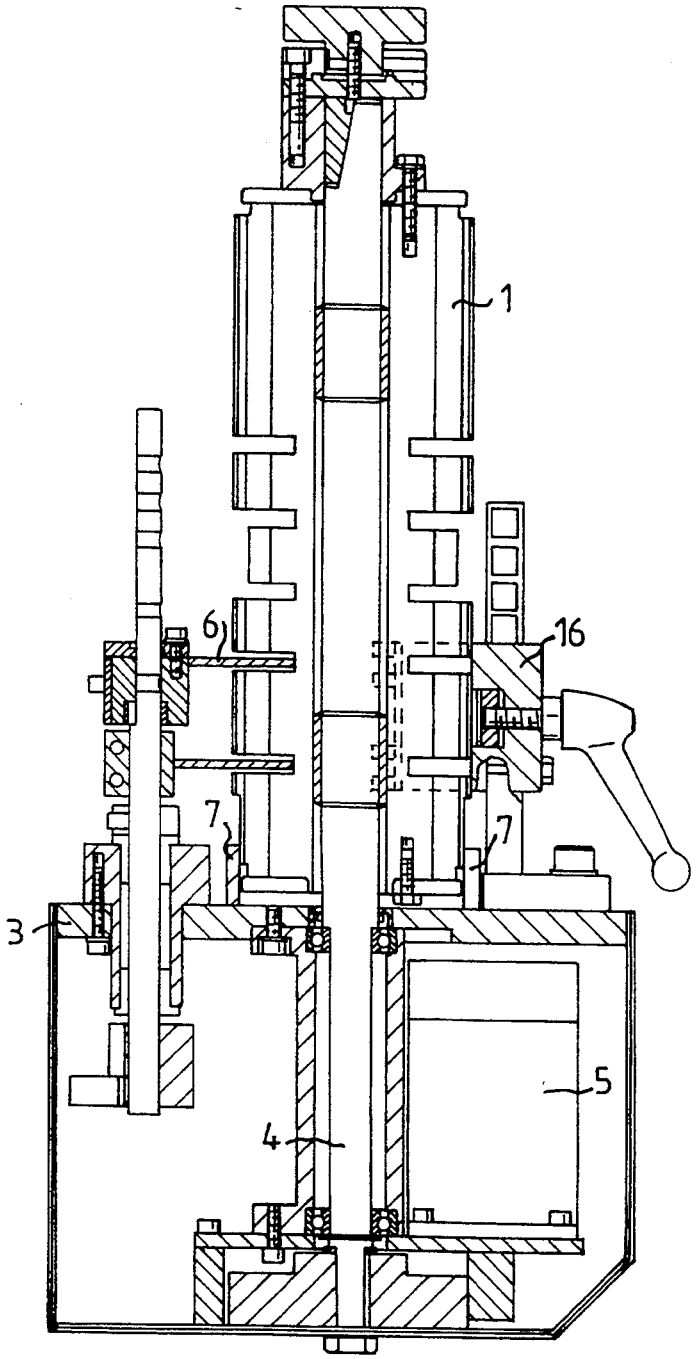
FIG. 3 is a side view partly in section a of the drive mechanism.

FIG. 3 shows how the adjustment plate 7 is situated very close to the feed wheel 1, which is possible if the adjustment plate 7 is made of a material with low friction, preferably plastic. The guide plate 7 in the preferred embodiment is placed at a distance of 0.1–0.8 mm from the feed wheel 1, preferably at a distance of 0.35 mm from the feed wheel 1. The feed wheel 1 is recess-turned at one end of it, where the adjustment plate 7 bears against the feed wheel 1. This is done so that the straw is not able to stick between the feed wheel 1 and the adjustment plate 7.

The two guide axles 8 which are employed in the preferred embodiment can be completely surrounded by the guide plate 7 or provided with a bushing 12 where they are inserted into the guide plate 7. If the guide plate 7 is made of a material with low friction, such as plastic, it is not necessary to provide the guide axles 8 with bushings 12. The guide axles 8 must make it possible for the guide plate 7 to be adjusted straight in the longitudinal direction of the feed wheel 1. Therefore only a single adjustment is required with the adjustment knob 10 which is fixed on the adjustment screw 9 that is preferably located between the two guide axles 8, for a more even guiding of the plate 7. FIG. 1 shows how the connected strip of straws 2 passes through the guide axles 8 via a guide roller 13 and via a further guide roller 14, and approaches the feed wheel 1 where each straw is placed in a cut-out 15 provided in the feed wheel 1. The straws are then fed round intermittently by the feed wheel 1, cut off from the strip form 2, held fast against the feed wheel 1 and finally applied to the individual packaging containers which are brought forward one by one on a conveyor art a point right opposite the feed wheel 1. During this entire process the strip 2 of straws is kept at the same height by the guide plate 7 even during the entire time when the straws are carried round by the feed wheel 1, in strip form 2 or after they have been cut off from the connected strip 2.

Regardless of whether the feed wheel 1 is horizontal in the application machine or it slants for a slanting attachment of straws, the connected strip 2 of straws will be kept at the same height position the whole time.

As can be seen from the above description a simple and sure holding of the height position of the connected strip of straws when it passes through the feed wheel is achieved with the present invention. Furthermore, with the present invention, the same feed wheel can be used for different lengths of straw, thereby minimizing and the requirement for different feed wheels for different types of straw which are to be found on the market. The invention makes possible a simple and quick adjustment of the height position of the straw.

While this invention has been illustrated and described in accordance with a preferred embodiment, it is recognized that variations and changes may be made and equivalents employed herein without departing from the invention as set forth in the claims.

What is Claimed is:

1. A device for guiding a strip of connected straws to a position at which the straws are individually separated from the strip and applied to packaging containers, comprising a feed wheel having an outer peripheral surface and oppositely positioned ends, said feed wheel having a plurality of recesses formed in its outer peripheral surface for receiving the straws, drive means connected to the feed wheel for rotatably driving the feed wheel to feed the straws in a forward direction, a guide plate surrounding at least a portion of one of the ends of the feed wheel, and means for adjusting the position of the guide plate relative to the feed wheel in a direction along the length of the feed wheel.

2. The device according to claim 1, wherein said guide plate is provided with an opening through which extends the feed wheel, said opening having an inner surface that faces toward the outer peripheral surface of the feed wheel, the inner surface of the opening being spaced from the outer peripheral surface of the feed wheel by a distance of about 0.1 mm–0.8 mm.

3. The device according to claim 1, wherein said means for adjusting the position of the guide plate includes an adjustment spindle having a screw-threaded end that threadably engages the guide plate, said adjustment spindle extending from the guide plate in a direction substantially parallel to the longitudinal axis of the feed wheel.

4. The device according to claim 3, including at least one guide axle extending through an opening in the guide plate for guiding the guide plate during movement relative to the feed wheel, said adjustment spindle being connected to said at least one guide axle and said adjustment spindle including an adjusting knob positioned on an end of the adjustment spindle that is located opposite said screw threaded end for adjusting the position of the guide plate.

5. The device according to claim 1, wherein the end of said feed wheel that is surrounded by said guide plate is notched.

6. The device according to claim 3, wherein said feed wheel extends through an opening in the guide plate and said guide plate includes a cut-out that allows access to the outer periphery of the feed wheel so that a separating device can separate individual straws from the strip of straws, said cut-out extending from an outer periphery of the guide plate and communicating with the opening in the guide plate.

7. A device for guiding a strip of connected objects so that the objects can be individually secured to packaging containers, comprising a rotatably mounted feed wheel for receiving objects on the strip and for feeding the objects in a forward direction, said feed wheel having a longitudinal axis and being rotatable about said longitudinal axis, an outer peripheral surface of said feed wheel being provided with a plurality of recesses for receiving the objects, and a guide plate surrounding at least a portion of one end of the feed wheel, said guide plate being movable relative to the feed wheel in a direction substantially parallel to the longitudinal axis of the feed wheel.

8. The device according to claim 7, including means for rotatably driving said feed wheel about the longitudinal axis of the feed wheel.

9. The device according to claim 7, wherein said guide plate is positioned on a supporting plate, said feed wheel being secured to said supporting plate and extending through a through opening in the guide plate.

10. The device according to claim 9, including at least one guide axle that extends through an opening in the guide plate for guiding the guide plate during movement.

11. The device according to claim 7, including means for adjusting the position of the guide plate relative to the feed wheel in a direction substantially parallel to the longitudinal axis of the feed wheel.

12. The device according to claim 7, including an adjustment spindle for adjusting the position of the guide plate relative to the feed wheel in a direction substantially parallel to the longitudinal axis of the feed wheel, said adjustment spindle having one screw-threaded end that threadably engages the guide plate and an opposite end that is provided with an adjusting knob for rotating the rod and adjusting the position of the guide plate relative to the feed wheel.

13. The device according to claim 1, wherein said feed wheel is substantially horizontally positioned and said recesses extend in a direction along the length of the feed wheel.

14. The device to claim 7, wherein said feed wheel is substantially horizontally positioned and said recesses extend in a direction along the length of the feed wheel.

15. The device according to claim 12, including two guide axles extending through the guide plate for guiding the guide plate during movement relative to the feed wheel.

16. An apparatus for guiding a strip of connected objects and for severing individual objects from the strip so that the individual objects can be secured to packaging containers, comprising: a rotatably mounted feed wheel for receiving objects on the strip and for feeding the objects in a forward direction, said feed wheel having a longitudinal axis and being rotatable about said longitudinal axis, an outer surface of said feed wheel including a plurality of recesses for receiving the objects; a separating device for separating individual objects from the strip of objects; and a guide plate surrounding at least a portion of one end of the feed wheel, said guide plate being movable relative to the feed wheel in a direction along the length of the feed wheel.

* * * * *